United States Patent [19]

Brook et al.

[11] Patent Number: 4,875,469

[45] Date of Patent: Oct. 24, 1989

[54] CONTINUOUS PASSIVE MOTION DEVICES AND METHODS

[75] Inventors: Arthur H. Brook, Rolling Hills Estates; Peter J. Carian, Inglewood; Leonard Katzin, Beverly Hills; Edmund E. Landsinger, Torrance; James D. Moore, Rancho Palos Verdes; Leah D. Rotter, Los Angeles; Stanley Schreiber, Marina Del Rey, all of Calif.

[73] Assignee: Innovative Medical Engineering, Inc., Hawthorne, Calif.

[21] Appl. No.: 206,269

[22] Filed: Jun. 13, 1988

[51] Int. Cl.[4] ..... A61H 1/02

[52] U.S. Cl. ..... 128/26; 272/67

[58] Field of Search ..... 128/26; 623/25, 64; 272/67

[56] References Cited

U.S. PATENT DOCUMENTS

| | | | |
|---|---|---|---|
| 3,631,542 | 1/1972 | Potter | 623/25 |
| 3,756,222 | 10/1973 | Ketchum | 128/26 |
| 3,871,646 | 3/1975 | Slack | 272/67 |
| 4,538,595 | 9/1985 | Hajianpour | 128/25 R |
| 4,576,148 | 3/1986 | Koerner et al. | 128/26 |
| 4,644,938 | 2/1987 | Yates et al. | 128/26 |
| 4,665,900 | 5/1987 | Saringer | 128/26 |
| 4,679,548 | 7/1987 | Pecheux | 128/26 |
| 4,724,827 | 2/1988 | Schenck | 128/26 |

OTHER PUBLICATIONS

"Hand Orthosis Dynamic Bracing Using Gauged Spiral Springs" by Allieu and Rouzaud, 10-1986.

*Primary Examiner*—Richard J. Apley
*Assistant Examiner*—Joe H. Cheng
*Attorney, Agent, or Firm*—Merchant, Gould, Smith, Edell, Welter & Schmidt

[57] ABSTRACT

A system for continuous passive motion of a limb or one or more fingers comprises a reciprocable carriage coupled to a drive belt which is driven by a motor through a disengageable clutch. A second drive belt also driven by the motor, and the first drive belt, carry elements whose positions can be sensed to control limits of motion. Individual finger actuators, adjustable in length and with internal springs, couple engagement means on the fingers to the carriage, which can be driven so as to provide predetermined dwell times at limits of flexion and extension.

23 Claims, 5 Drawing Sheets

CONTINUOUS PASSIVE MOTION DEVICES AND METHODS

BACKGROUND OF THE INVENTION

This invention relates to devices for imparting continuous passive motion to a limb or digit, and more particularly to portable units for exercising joints of the hand, fingers and wrist.

It has been standard medical procedure for many years to use exercise routines to restore mobility of limbs and joints after injury or immobilization, so as to overcome muscle degeneration and internal adhesions. It has more recently been recognized that "continuous passive motion" (CPM) exercises are desirable following traumatic incidents or operations. They can be initiated quickly, and by providing motion of a limb or digit, establish or maintain freedom of motion well before the musculature can function autonomously. Continuous passive motion devices have accordingly been developed in a number of forms, as evidenced by U.S. Pat. Nos. 4,487,199, 4,537,083 and 4,716,889. The devices depicted therein are not indicative of the state of the art, however, since units with additional features have been sold for some time by Kinetec of France, and by Toronto Medical Inc. of Yellow Springs, Ohio. Even such units, however, provide only a limited ability to supply motion effects and controls as dictated by a therapist for a given individual. The French system is a relatively cumbersome unit which must be operated from a power main. The Toronto Medical Inc. product is a portable battery operated device for exercising the fingers. A light weight battery operated CPM is very useful because of the frequency of occurrence of hand injuries, provided that a variety of manipulative CPM functions can be performed. It may be desirable, for example, to reciprocate the fingers from an intermediate partially flexed position to fully extended position, to reciprocate the fingers between partially flexed and fully clenched positions, or to use any other combination of finger or digit motions. It is evident that the same unit with minor adjustments or replacements should function for all desired finger positions. In addition, the unit should also be adaptable for imparting continuous passive motion to the thumb, and alternatively to the wrist. The unit should also permit a therapist to exercise only certain fingers and to introduce digit blocking or to exercise only particular fingers or joints.

In addition, ease of attachment, setting and adjustment are of significant importance inasmuch as the patient must ordinarily operate the machine after selection of specific exercises by the therapist. Settings should be easily controllable by the patient or therapist, and the design should enable full motion of each finger, if desired, despite variations in hand size, finger length, and finger alignment. Not only the extent of travel but also the rate of travel should be controllable.

As evidenced by the above referenced patents, it has been thought desirable to automatically reverse the reciprocating motion upon encountering a predetermined load. This type of control is very difficult to achieve, particularly because finger loadings are not uniform. Moreover with a properly adjusted device there is no need for such a function. In fact, it is often desirable to introduce stretching forces, in order to overcome adhesions and inhibiting forces, and to do so independently on each finger. Sometimes the fingers should be maintained in a given position for a dwell period at the end of a motion, providing a traction effect that enhances the healing process. Nonetheless, the action as far as each finger is concerned should be force limiting and a range of adjustment should cover the range of travel down to as little as one-quarter inch.

Superimposed on all of these requirements, a portable CPM unit should not only be light in weight but efficient in operation so that it can operate for a long interval on battery power. Moreover, not only the range of travel but the speed of reciprocation should be adjustable. Various useful features, such as counting the number of cycles, automatic resetting and manual or automatic operation, should also be provided.

SUMMARY OF THE INVENTION

An improved battery powered CPM device for hand, thumb and wrist applications incorporates a double belt drive system in which the belts are drivable from a motor and engageable by an intercoupling clutch. A carriage engaged to a primary drive belt is the base for one or a number of telescoping finger actuators which are internally spring loaded and pivotable through limited angles. Flag elements coupled to the belts are separately settable to define opposite limit positions with the belt drive disengaged, by taking the fingers or wrist through the desired range of motion. Thereafter, simply engaging the clutch starts the run operation. The belts and carriage are reciprocated at a selected and variable rate between the defined limit positions under solid state electronic control which counts the cycles and reverses the motor, introducing dwell times as desired. The unit may be automatically reset whenever the range of travel is changed.

The base unit is coupled to a unit holder which is mountable on the forearm and enables the carriage to be coupled to actuators for any or all of the four fingers or the thumb or via an attachment to the wrist. The fingers may be exercised through different ranges including from fully extended to flexed and from flexed to clenched, by reorientation of the elements.

The telescoping finger actuators are mounted on the carriage so as to be pivotable through small diverging angles to conform to the shape of the hand and fingers of the individual patient. The finger actuators include base tubes receiving rod extensions which may be locked in selected axial positions. Terminal flexible spring wires on the actuators are engaged to finger attachments at their outer end, and are seated within the rod extensions between a pair of compression springs at their opposite end. Thus, whether moving the fingers toward the extended or clenched position, the actuators, which are readily adjusted to individual finger lengths, introduce a spring force against the fingers.

The device is mounted on an arm cuff that fits on the forearm and provides a base that accommodates different arm sizes. The device may be mounted directly on the arm cuff, or on a separate unit holder, which may incorporate a pivotable base surface for providing a controlled degree of tilt relative to the wrist angle in the lateral and vertical planes. The anterior of the arm cuff includes a tang on which a thermoplastically deformable palm support or digit blocking device can be engaged after shaping to the particular needs of the patient's hand.

Finger attachments for coupling to the finger actuators advantageously comprise arcuate elements partially encompassing a finger tip and including a protruding lever arm engageable to the flexible actuator wires. Forces exerted on the finger tips by the actuators act against the sides of the fingers in shear. Securement to the fingers can be within the attachment and elastic coupled to close the arcuate elements. The attachments may be placed on the fingers in inverted position so that motion can be introduced to provide a clenched fist.

The same unit can be used to provide continuous passive motion of one or more digits, including the thumb. With an adaptor it may also be used to exercise the wrist. It can be increased in size and drive capability to move other limbs, such as the elbow and knee, with appropriate known types of attachments.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
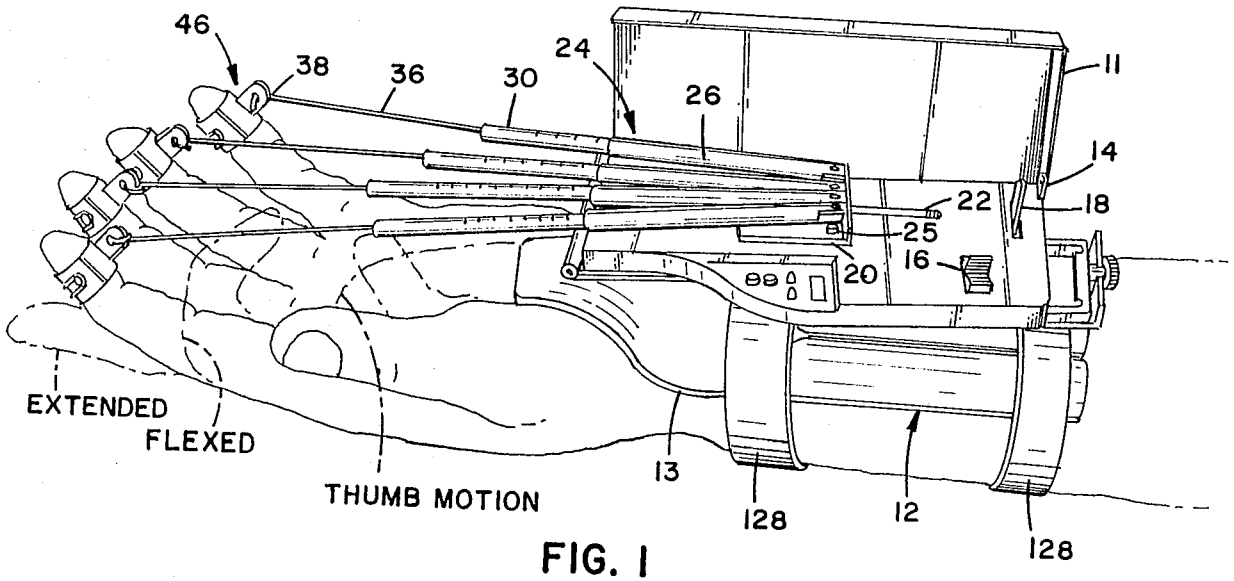
FIG. 1 is a perspective view of a continuous passive motion device in accordance with the invention.
Figure 2:
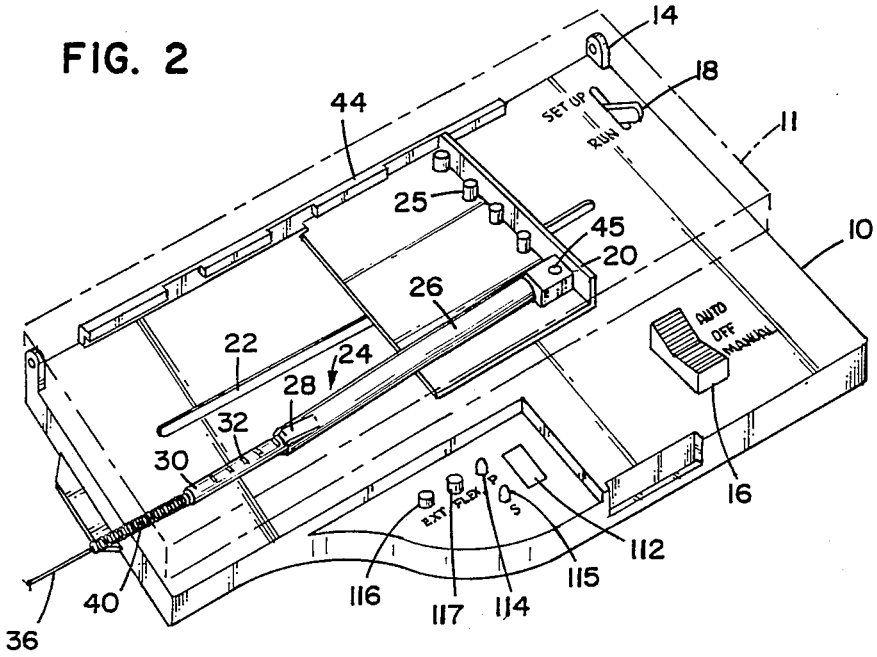
FIG. 2 is a different perspective view, partially broken away, of a portion of the arrangement of FIG. 1.
Figure 3:
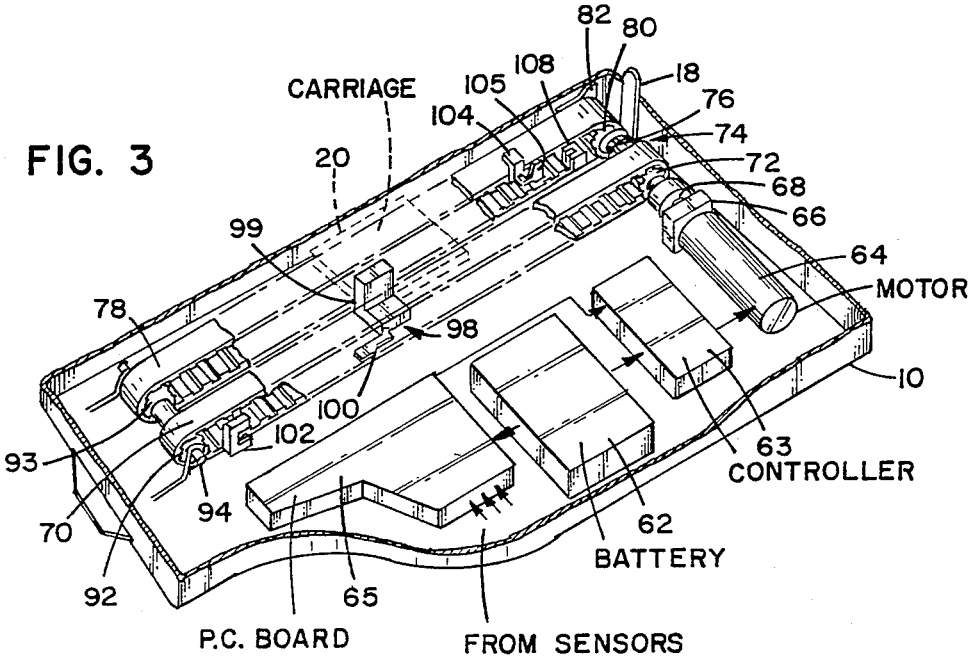
FIG. 3 is a second fragmentary view of the arrangement of FIG. 1, showing internal details thereof.

Referring now to FIGS. 1–3, devices in accordance with the invention comprise a housing 10 which contains or supports the principal drive elements and in addition a battery, motor and controller. The housing 10 has a hinged cover 11 and is mounted on a support 12 which is affixed to the forearm, here positioning the housing 10 so that it is adjacent the palm of the hand, to enable the fingers to be flexed from a fully extended to partially flexed position in this example. A foam pad 13 (FIG. 1) is typically disposed on the wrist under the support 12. The cover 11 is mounted on the housing 10 by pivot hinges 14 along one edge and encompasses some of the exterior drive elements and controls, such as an on-off control switch 16, and a control lever 18. The lever 18 is shiftable manually between setup and run positions, and is moved automatically to the run position by the cover when the cover 11 is closed.

Figure 5:
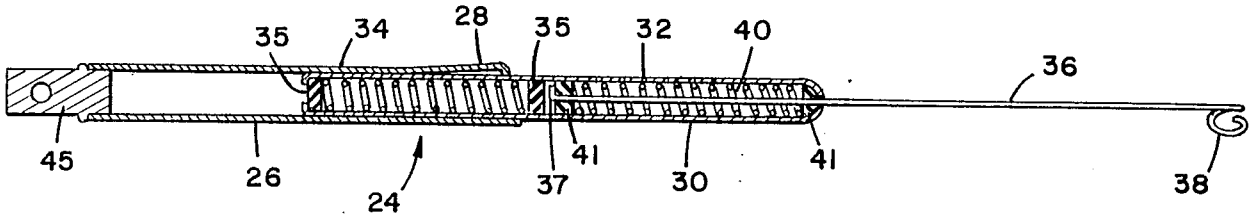
FIG. 5 is a side sectional view of finger actuators used in the arrangement of FIGS. 1–4.

The housing 10 supports a linearly movable carriage 20 which is coupled to a drive mechanism inside the body through a linear slot 22 that extends in the posterior/anterior direction. A number of finger actuator assemblies 24 are individually mounted on pivot pins 25 on the posterior end of the carriage 20, extending outwardly toward the finger tips. The finger actuator assemblies 24 each include a base tube 26 having a tang 28 at its free end that is incurved to grip a slidable inserted hollow extension rod 30 at a selected telescoping position. These positions are defined by a number of longitudinally spaced short peripheral slots 32 periodically spaced along the extension rod 30 and receiving the tips of the tangs 28. A first spring 34 is disposed in the extension rod 30 at the posterior end, as seen in FIG. 5, within end caps 35 which permit compressive forces to be exerted smoothly on the first spring 34. A strong but resilient wire element 36 having a terminating projection 37 at its end inside the extension rod 30 and an end loop 38 at its anterior end provides the means for coupling to an individual finger attachment. Between the terminating extension 37 and the anterior end, within the extension rod 30, is disposed a second spring 40 between end caps 41 having central apertures through which the wire 36 is inserted and moves.

The carriage 20 moves along the exposed surface of the housing 10, between a side rail 44 and a side wall of the cover 11, which restrict outward divergence of the finger actuators 24. The bases 45 of the actuators 24 include holes fitting about the pivot pins 25, and are sized to limit the maximum angle of divergence between adjacent actuators 24.

Figure 9:
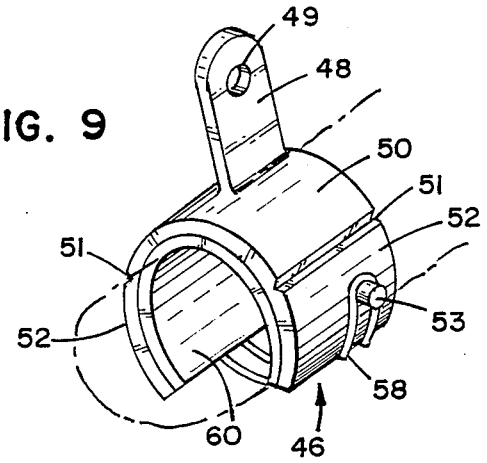
FIG. 9 is a fragmentary perspective view of a finger attachment device used in the arrangement of FIGS. 1–4.

The end loops 38 on the wires 36 are each coupled to a finger attachment device 46 at a protruding lever arm 48, by passing through a transverse opening 49 on the lever arm 48. The finger attachment device 46, best seen in FIG. 9, comprises a curved base 50 which conforms to the pad of a finger tip and is bounded on each side by a hinge 51 joining to an adjacent side panel 52. Each side panel includes a protruding post 53, so that the device can be curved snugly about the finger by an elastic band 58 coupling the posts 53. Such posts may be provided alternatively on the base 50 or the arm 48. A foam insert 60 having adhesive surfaces on both sides is disposed between the finger attachment device 46 and the finger to increase adhesion and resistance to shear forces. For some applications a foam insert will not be needed. The entire finger attachment device 46 apart from the foam insert 60 and the elastic band 58 is conveniently molded as a single integral piece.

Figure 4:
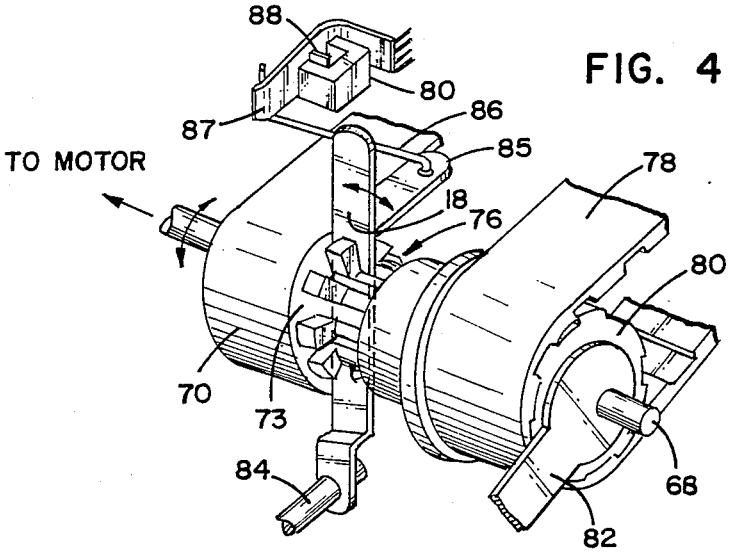
FIG. 4 is a fragmentary perspective view, partially broken away, of a portion of the arrangement of FIGS. 1–3, showing details of the clutch and drive subsystem.

The energy source and drive mechanism, as well as the internal sensing and control system, are disposed within the body, as may be seen by reference to FIGS. 3 and 4. A battery 62 is coupled via a controller 63 to a D.C. drive motor 64. The controller 63 also receives sensor signals via a P.C. board 65 and contains circuitry for controlling reciprocating motion at a selectable velocity between choosable limits, for enabling manual and automatic operation, and for providing an indication of the number of cycles of operation, as well as automatic reset. Such functions can be controlled individually by separate conventional circuits but the cost and flexibility of integrated circuit chips enable these features, together with many more if desired, to be provided at reasonable cost.

The motor 64 is mounted in the housing 10, being principally supported in the motor mount 66 at its shaft 68 end, and the shaft being conventonally seated between bearing plates in the body. The shaft 68 extends in a direction perpendicular to the direction of reciprocation of the carriage 20. A first drive belt 70 engages a first drive pulley 72 on the shaft 68, the first drive pulley being rotatable on the shaft 68, but having a clutch face with circumferentially spaced slots 73 on the side opposite the motor 64. It will be appreciated that the motor shaft need not be integral but may include one or more colinear sections or couplings. A clutch element 74 about the shaft 68 includes a set of protruding dogs 76 configured to mate within the drive pulley slots 73, the clutch elements 74 being axially movable toward the motor 64 by the control lever 18 as described hereafter. Thus when the clutch element 74 is engaged with the dogs 76 in the drive pulley slots 73, the clutch element, which is coupled to the shaft 68, rotates the first drive belt 70 with the shaft 68.

A second drive belt 78, parallel to the drive belt 70 but spaced apart along the shaft 68 on the opposite side of the clutch element 74, is directly coupled to the motor shaft 68 by a second drive pulley 80, which is axially movable along the shaft on a splined section (not shown in detail). A leaf spring 82 mounted on the side of the device body 10 urges the second drive pulley 80 in the direction toward the motor 64, but engagement of the clutch device is controlled by the control lever 18. The upper end of the lever 18 is accessible through a slot from the top of the body 10, while the lower end is mounted on a pivot 84 in the wall of the body 10. A side of the control lever 18 engages the adjacent side of the first drive pulley 72 next to the slots 73, and in the "setup" position of the control lever 18 shifts the first drive pulley out of engagement with the dogs 76 on the clutch element 74. At the opposite limit of pivot position, the "run" position, the control lever 18 permits engagement of the dogs 76 into the drive pulley slots 73. A bracket 85 extending from a mid-region of the control lever 18 carries a wire arm 86 which, in the "run" position, engages a spring actuator 87 having a tab 88 which passes into the optical path of a position sensor 90 of the type having a small miniaturized light source on one side and a light sensor on the other. Signals from this sensor 90 are passed to the P.C. board 65 and controller 63 for use in the system.

At the end of their linear paths opposite from the motor 64, the first and second drive belts 70, 78, are turned about driven pulleys 92, 93 mounted on a common shaft 94 coupled to the body 10. A bracket 98 coupled to the first drive belt by a U-shaped element 99 is coupled to the carriage 20 through the linear slot 22 (not seen in FIG. 3), to control carriage motion and position. A flag 100 on the bracket 98 extends in the anterior direction, along a path adjacent to the first drive belt 70, and at a predetermined limit position near the driven pulleys 72, 73, passes into the optical path of a second position sensor 102. A fixture 104 mounted on the second drive belt 78 carries a flag 105 directed in the posterior direction which intercepts the optical path of a third position sensor 108 at a limit position.

On top of the body 10, referring to FIGS. 1 and 2, the control switch 16 has automatic, manual and off positions accessible to the user. A digital display 112 visible to the user provides the count generated by the controller 63. Rotatable control buttons 114, 115, designated P and S can be used to adjust the dwell time before reversal of direction and the rate of travel of the carriage 20, respectively. In manual operation a pair of depressible buttons 116, 117 labeled "Extend" and "Flex" respectively, can operate the motor in the given directions.

Figure 6:
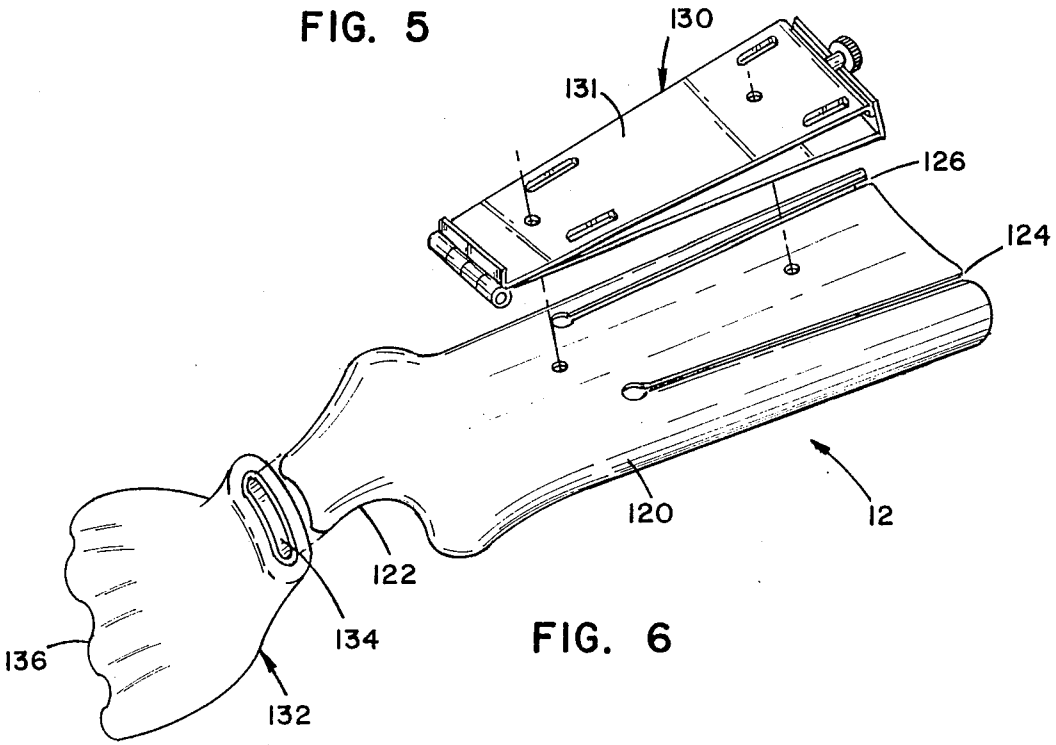
FIG. 6 is an exploded view of unit holder and digit blocker devices for use in the arrangement of FIGS. 1–4.
Figure 10:
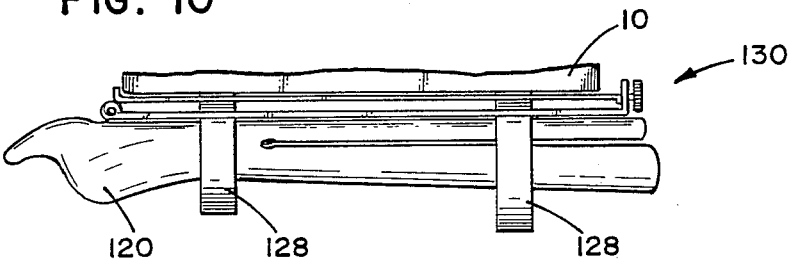
FIG. 10 is a side sectional view of a portion of the housing unit holder and arm cuff of FIG. 6.

As best seen in FIG. 6, the support 12 may comprise an arm cuff 120 having an anterior tang 122 and a shaped configuration for fitting smoothly about the base of the wrist, with the tang 122 extending onto the palm. At the posterior end of the arm cuff 120 are provided slots 124, which establish flexible side wings 126 so that the arm cuff may be fitted onto forearms of substantially varying sizes. Straps 128 with conventional means for joinder, such as snaps or "Velcro" are placed about the arm cuff 120 and the forearm. The housing 10 may be inserted directly with a snap attachment into the arm cuff 120, or optionally may be mounted, as seen in FIGS. 6 and 10, on a hinged base support or unit holder 130 having an upper surface 131 which can be raised to different angular positions for best fitting to the particular hand or function. Alternatively also, a digit blocker 132 having a shaped slot 134 may be fitted onto the tang 122 on the arm cuff 120, so as to restrict movement of individual joints in any fashion that a therapist may desire. The anterior portion of the digit blocker comprises a shaped body 136 of thermoformable plastic. Plastic materials are available which are rigid at ambient temperature but which become plastic at moderate temperatures (e.g. hot water below boiling) and which may therefore be shaped, cut and fit by a therapist to fit the palm and particular needs of an individual patient, and then allowed to cool to rigidity.

The operation of the system of FIGS. 1–6 proceeds by first attaching the finger attachments 46 to the fingers as desired. For use in continuous passive motion between the fully extended and partially clenched positions, the finger attachments 46 are seated with the lever arms 48 protruding from the finger tip pads, and the wires 36 are then engaged to the lever arms by inserting the end loops 38, which permit bidirectional motion. The base tubes 26 can conveniently be kept on the pivot pins 25, and the extension rods 30 can be temporarily extracted for this attachment. The fingers are then fully extended, and the extension rods 30 are extended or contracted to given positions, within the base tubes 26, by rotating the rods 30 through a small angle so that the slots 32 are not in alignment with the tangs 28 on the base tube 26. Thus each finger can be precisely adjusted in length, and the tension at the fully extended position can also be controlled, by the length of the extension. The springs 34, 40 inside the extension rod 30 have approximately equal compliance and thus will compress slightly under light force, as determined by a therapist or user. With the support 12 strapped onto the wrist, and the housing 10 of the device attached, the hinged cover 11 can be opened to permit these adjustments to be made. The control lever 18 is shifted to the "setup" position, which frees the first drive belt 70 from the motor shaft 68, allowing the carriage 20 to be moved, along with the fingers, posteriorly to a selected flex position. Prior to this time, however, the controller 63 automatically drives the motor 64 to bring the second drive belt 78 toward the rearward position, until the flag 105 on the fixture 104 for the second drive belt 78 intercepts the third position sensor 108. This therefore provides a reference for the flexed position of the drive system. When the carriage 20 is moved, along with the fingers, to the desired flex position, only the first drive belt 70 moves with it, starting from the fully extended position in which the flag 100 on the bracket is at the second position sensor 102.

This sequence is very simply established for the therapist or user, and if the stroke adjustment are not as desired, the sequence maybe quickly repeated to achieve final settings. By setting the posterior reference point using the second drive belt 78, and the anterior reference point using the first drive belt 70, in accordance with actual positions of the fingers, there is no possibility of mistake. The system may then be shifted from the "setup" mode to the "run" mode simply by shifting the control lever 18 and closing the cover 11. It is advantageous to position the control lever 18 as shown, so that this shift in control lever position automatically occurs when the cover 11 is closed.

The unit thus operates continuously, at the selected advance and return velocities, in reciprocating fashion, with the limiting positions of the carriage 20 being sensed by the second and third optical sensors 102, 108, respectively. The cycles of movement are counted and displayed, and if the system is reset, the count, in this example, is started over again.

The physical movement of the finger tips is precisely controlled, because the divergence of the finger actuators 24 corresponds to actual finger alignment, and because the arrangement of the finger attachments 46 aids in proper vectorial distribution of forces. The forces which draw the fingers inwardly and extend them reciprocally act on the lever arms 48, but are absorbed in shear at the side panels 52, rather than the fleshy part at the pad of the finger.

Figure 7:
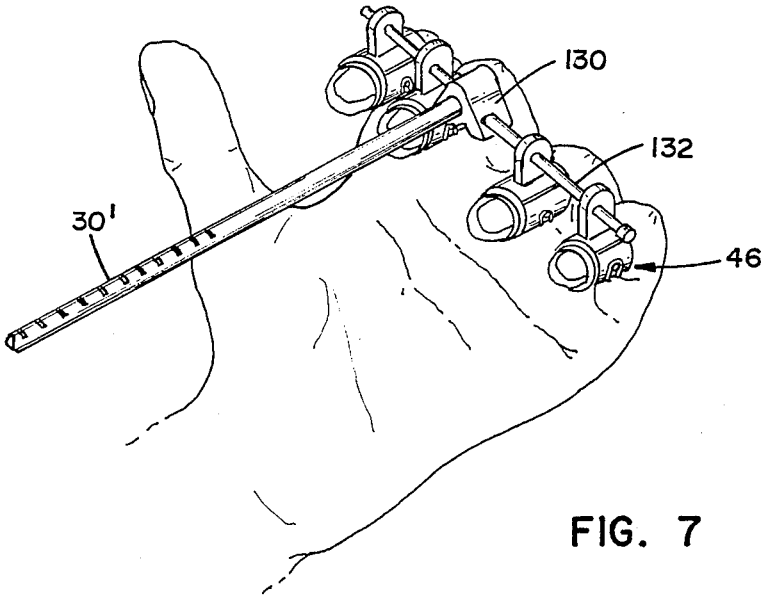
FIG. 7 is a perspective view of a device in accordance with the invention mounted for moving the fingers from flexed to fully clenched position.

As seen in FIG. 7, if it is desired to move the fingers between partially flexed and fully clenched position, the finger attachments 46 are reversed or inverted, with the protruding lever arms extending outwardly from the fingernails. Now, as seen in FIG. 7, the fingers can be drawn from a partially flexed position down into contact with the palm of the hand. The same carriage 20 and base tube 26 arrangement are employed, but the extension rod 30' is terminated by a bracket 130 supporting a transverse bar 132 which fits through the holes in the finger attachments 46. This enables movement to form a complete fist.

In either mode of operation, the finger actuator structure plays an important part in the distribution of forces. The wire elements 36 compress the first springs 34 when extending, and compress the second springs 40 when flexing the fingers. When the fingers are fully flexed, the actuators can be adjusted to provide a given tension force on them, by placement of the tension rods 30 relative to the base tubes 26. This provides an important therapeutic advantage, because it is often useful to hold the fingers under tension at a limit position for a period of time prior to continuing with the reciprocating motion. This dwell time can be adjusted using the controller 36 and the selector buttons 114, 115.

The same unit, with the single finger actuator, can be used for controlling the motion of the thumb through different ranges as shown in dotted lines in FIG. 1. The attachment 46 to the end of the thumb can be placed as desired, and the wire element 36 extending from the finger actuator 24 is typically substantially bent, but still functions to provide the control thumb motion that is desired.

Figure 8:
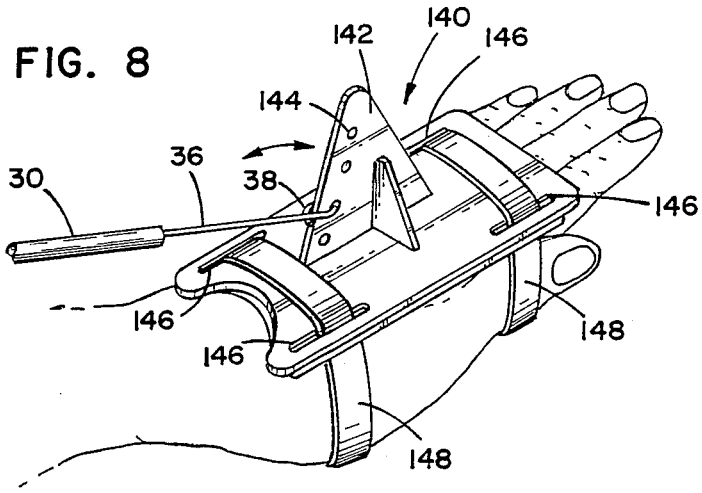
FIG. 8 is a perspective view of a device in accordance with the invention with an attachment for continuous passive motion of the wrist.

In another example in accordance with the invention, as seen in FIG. 8, the entire wrist can be exercised in continuous passive motion. A wrist adaptor 140 fitting about the back or palm of the hand includes an upwardly extending lever 142 to which the wire loop 38 is attached at one of a number of spaced apart holes 144. The body of the adaptor 140 includes slots 146 for receiving attachment straps 148 by which the unit can be affixed to the extensor surface of the patient's forearm. The nature and arc of the continuous passive motion can be selected by using different ones of the holes 144.

The ability to control the motion of any one or more digits including the thumb, is very useful for patients and therapists, but is only one of many structural, operative and therapeutic advantages. The ability to introduce a controlled dwell interval, in both flexion and extension if desired, with tension being maintained during the dwell interval because of the internal springs, adds a new therapeutic capability. Because the actuators are individually adjustable to finger length and can accommodate finger position and direction to an acceptable degree, there is no danger of excessive strain. For this reason and because of the compression springs, resistance by one or more digits against movement is reacted against by compliance and there is no need for direction reversal.

The device can be mounted on either forearm so as to function with either hand. If a cast is in place the unit holder can be strapped directly onto it, without an intervening arm cuff.

While various forms and modifications have been described above, it will be appreciated that the invention is not limited thereto but encompasses all forms and variations within the scope of the appended claims.

What is claimed is:

1. The method of operating a continuous passive motion device for the fingers, to provide a controlled range of motion for each finger, using a reciprocable carriage to which individual finger attachable and length adjustable finger actuators are secured and also using a pair of movable belts, comprising the steps of:
   - moving the carriage with a first belt to an anterior limit of position while maintaining a second belt at a posterior limit of position;
   - securing the individual finger actuators to the tips of the fingers while adjusting the length of the individual finger actuators;
   - flexing the fingers, the carriage, and the individual finger actuators while maintaining the second belt at the posterior limit position,
   - coupling the two belts together; and
   - driving the two belts together in reciprocating fashion by sensing an anterior limit position of the first belt and the posterior limit position of the second belt.

2. The method as set forth in claim 1 above, including the additional step of having a dwell time at the anterior limit of motion while concurrently tensioning the fingers individually.

3. The method set forth in claim 2 above, further including the steps of indexing the second drive belt to the posterior limit position before moving the carriage, and adjusting the lengths of the finger actuators to provide tension at the posterior limit position.

4. A method of exercising a finger with a continuous passive motion device comprising the steps of:
   - moving the finger in a first direction against a first spring force, movement in the first direction tending to orient the finger in an extended position;
   - moving the finger in a second direction opposite the first direction against a second spring force, movement in the second direction tending to orient the finger in a contracted position;
   - maintaining the finger in the extended position against the first spring force for a dwell time between motion reversals; and
   - securing the finger to a individual finger attachable and length adjustable finger actuators and to a reciprocable carriage such that a tensile force is exerted on the finger at a limit of motion for both extension and flexion.

5. A system for providing continuous passive motion of at least one of the fingers of the hand comprising:

a support for securing the system to the region of the wrist;

a housing rigidly coupled to the support for containing a drive mechanism, the housing including rigidly mounted motor means, battery means for energizing the motor means, and controller means for varying the excitation of the motor means in speed and direction;

a pair of belt drives coupled to the housing, and movable with respect thereto, a first of the belt drives being coupled to the motor means by clutch means and a second of the belt drives being directly coupled to the motor means;

carriage means being slidably mounted on the housing and coupled to the first belt drive, the first and second belt drives and the carriage means being movable along a predetermined axis generally parallel to the direction of desired finger movement;

adjustable elongated means pivotably coupled to the carriage means and extending therefrom in the direction of the finger tips parallel to the predetermined axis, and each of the adjustable elongated means including means for gripping a finger, such that motion of the motor means may be coupled to the adjustable elongated means so as to manipulate each gripped finger;

sensors means for sensing an anterior limit position of the second belt drive;

and wherein the controller means includes means for driving the motor means in reversing directions such that the belt drives move together between the anterior and posterior limit positions sensed by the sensor means when the clutch means is engaged so as to define a region of manipulation for each gripped finger.

6. A system as set forth in claim 5 above, including lever means cooperatively connected to the clutch means for engaging the clutch means to drive the belt drives together so as to ultimately control the manipulation of each gripped finger.

7. A system as set forth in claim 5 above, wherein said means for gripping a finger comprise individual lengthwise adjustable elements having extensible spring means coupling said adjustable elongated means to the individual fingers so as to compensate for varying lengths of finger.

8. A system as set forth in claim 11 above, further comprising:

(a) the pair of belt drives is spaced apart and parallel belt drives, each of the belt drives having first and second ends and including pulley means proximate the first and second ends of the belt drives;

(b) flag means mounted in a selected region of the belt drives;

(c) a first photoelectric flag sensor means positioned at the posterior limit position; and (d) a second photoelectric flag sensor means positioned at the anterior limit position.

9. A system as set forth in claim 8 above, wherein the clutch means comprises a member axially movable along a predetermined motor shaft axis, to engage a concentric pulley of the pulley means for the second belt drive to the motor shaft axis, and lever means for controlling the clutch means position; and wherein the system further includes a cover to engage the lever means for engaging the clutch means into an automatically run position when the cover is closed.

10. A system as set forth in claim 5 above, wherein the adjustable elongated means comprise a base tube, an elongated rod adjustably seated in the base tube, first and second springs having predetermined compliance disposed serially within the base tube, and an elongated wire extending through the elongated rod and disposed between the first and second springs and coupled at a first end to the means for gripping the finger, such that the springs permit relative movement against resistance.

11. A system as set forth in claim 5 above, wherein the means for gripping the finger includes a separate finger holder for attachment to the tip of each finger to be subjected to motion, the separate finger holder including an extending lever arm for attachment to the elongated wire, and means for resiliently securing the separate finger holder to the finger.

12. A system as set forth in claim 11 above, wherein the finger holder has a substantially semicircular shape in cross section, including a base portion coupled to the lever, and side panels, the side panels being coupled to the base portion by hinges.

13. A system as set forth in claim 12 above, including a foam insert within the semicircular structure having adhesive on both sides, the side panels engaging the side of the finger and controlling motion of the finger substantially by shear forces.

14. A system as set forth in claim 5 above, wherein the support includes side surfaces along the direction of movement of the carriage means for limiting a degree of divergence of the adjustable elongated means.

15. A system as set forth in claim 14 above, including pivot pins coupling the adjustable elongated means to the carriage means to permit the degree of divergence between the adjustable elongated means.

16. A system as set forth in claim 11 above, wherein the system operates in a cyclic fashion, and includes means for counting and displaying the cycles undertaken, and means for starting running of the carriage means between the anterior and posterior limit positions when a cover mounted on the housing is closed.

17. A system as set forth in claim 5 above, wherein the adjustable elongated means includes spring means for exerting tension on the fingers when the fingers are in an extended position, and the controller means prevents movement of the carriage means for a predetermined dwell time when the fingers are in the extended position, so as to maintain the fingers under tension for a period of time before the controller means permits movement of the carriage means.

18. An actuator for coupling a reciprocating member in a continuous passive motion device to a finger to be exercised along a selected direction, comprising:

length variable actuator rod means for engagement to the device and movable therewith along the selected direction;

substantially linear flexible actuator wire means disposed partially inside the actuator rod means along the selected direction for coupling at an opposite end to the finger to be exercised; and a pair of spring means coupling the rod means to the wire means to provide spring force on the finger in each direction without regard to dimensions of the finger when the actuator rod means has been adjusted.

19. An actuator as set forth in claim 18 above, wherein the actuator rod means comprises a base sleeve and an extension rod telescoped into the sleeve, and wherein the wire means extends the extension rod, and the spring means are disposed within the extension rod on opposite sides of an end of the wire means and exert force on the finger via the wire means depending on the direction of movement of the actuator rod.

20. A drive system for reciprocating a carriage in a continuous passive motion device comprising:

a battery;

a drive motor including a drive shaft;

controller means for energizing the motor at selectable speeds and directions;

belt drive means comprising first and second parallel belt drives disposed along a predetermined path, and including pulleys adjacent each end of the first and second parallel belt drives along the path, wherein the pulleys at one end of the first and second parallel belt drives are concentric with the drive shaft; a first one of said pulleys is coupled to the drive shaft, and the first parallel belt drive is engagable to an adjacent carriage and a second one of said pulleys;

clutch means for selectively coupling the second one of the pulleys to the drive shaft;

separate flag means coupled to each of the belt drive means and movable therewith; and separate sensor means disposed along the predetermined path at selected regions, the sensor means being coupled to the controller means to generate control signals.

21. A drive system as set forth in claim 20 above, wherein the separate flag means comprise a first flag individually coupled to the first belt drive means and a second flag individually coupled to the second belt drive means wherein the separate sensor means for the first flag on the first parallel belt drive is disposed in a reciprocal travel limit position and the separate sensor means for the second flag on the second parallel belt drive is disposed at an opposite travel limit position.

22. The drive system as set forth in claim 21 above, wherein the clutch means comprises a clutch member reciprocable on the motor drive shaft between the pulleys, wherein the second pulley is slidable along the drive shaft of the drive motor, and wherein the system further includes control handle means for controlling the position of the first pulley on the motor shaft and spring means for urging the second pulley toward the clutch means and the first pulley.

23. An actuator for coupling a reciprocating member in a continuous passive motion device to a limb to be exercised along a selected direction, comprising:

length variable actuator rod means for engagement to the device and movable therewith along the selected direction;

substantially linear flexible actuator wire means disposed partially inside the actuator rod means along the selected direction for coupling at an opposite end to the limb to be exercised; and a pair of spring means coupling the rod means to the wire means to provide spring force on the limb in each direction without regard to dimensions of the limb when the actuator rod means has been adjusted.

* * * * *